US005273030A

United States Patent [19]

Crome

[11] Patent Number: 5,273,030

[45] Date of Patent: Dec. 28, 1993

[54] CHEST-MOUNTED BREATHING GAS TERMINAL BLOCK ASSEMBLY

[75] Inventor: Victor P. Crome, Davenport, Iowa

[73] Assignee: Litton Systems, Inc., Davenport, Iowa

[21] Appl. No.: 817,208

[22] Filed: Jan. 6, 1992

[51] Int. Cl.[5] ..... A62B 17/00

[52] U.S. Cl. ..... 128/202.11; 128/202.12; 128/202.27

[58] Field of Search ..... 128/202.11, 202.27, 128/202.12; 600/20

[56] References Cited

U.S. PATENT DOCUMENTS

| | | | |
|---|---|---|---|
| 2,390,233 | 12/1945 | Akerman et al. | 128/202.11 |
| 2,482,292 | 9/1949 | Sabbia | 128/202.27 |
| 2,814,290 | 11/1957 | Holmes | 128/202.11 |
| 2,824,557 | 2/1958 | Mejean et al. | 128/202.11 |
| 3,034,131 | 5/1962 | Lent | 600/20 |
| 3,521,627 | 7/1970 | Murray | 128/202.27 |
| 4,619,255 | 10/1986 | Spinosa et al. | 128/202.27 |
| 4,799,476 | 1/1989 | McGrady | 600/20 |
| 4,925,133 | 5/1990 | Wurst et al. | 600/20 |
| 5,072,727 | 12/1991 | Avonne | 128/202.11 |
| 5,129,389 | 7/1992 | Tauscher et al. | 128/202.11 |
| 5,156,146 | 10/1992 | Corces et al. | 128/202.27 |

FOREIGN PATENT DOCUMENTS

| | | | |
|---|---|---|---|
| 1129376 | 5/1962 | Fed. Rep. of Germany . | |
| 741127 | 2/1933 | France | 128/202.11 |
| 1291491 | 3/1962 | France | 128/202.11 |

*Primary Examiner*—Edgar S. Burr
*Assistant Examiner*—Aaron J. Lewis
*Attorney, Agent, or Firm*—Brian L. Ribando

[57] ABSTRACT

A pneumatic terminal block assembly worn by a Pilot couples breathing gas from a regulator to the pilot's breathing mask. An emergency breathing gas supply attached to the pilot's seat remains with the pilot during ejection and supplies high pressure breathing gas to an emergency regulator which is part of the terminal block assembly. The emergency regulator on the terminal block is coupled to the emergency breathing gas supply by a small diameter high pressure hose which is not susceptible to tearing or kinking during ejection caused by the blast of oncoming air.

4 Claims, 1 Drawing Sheet

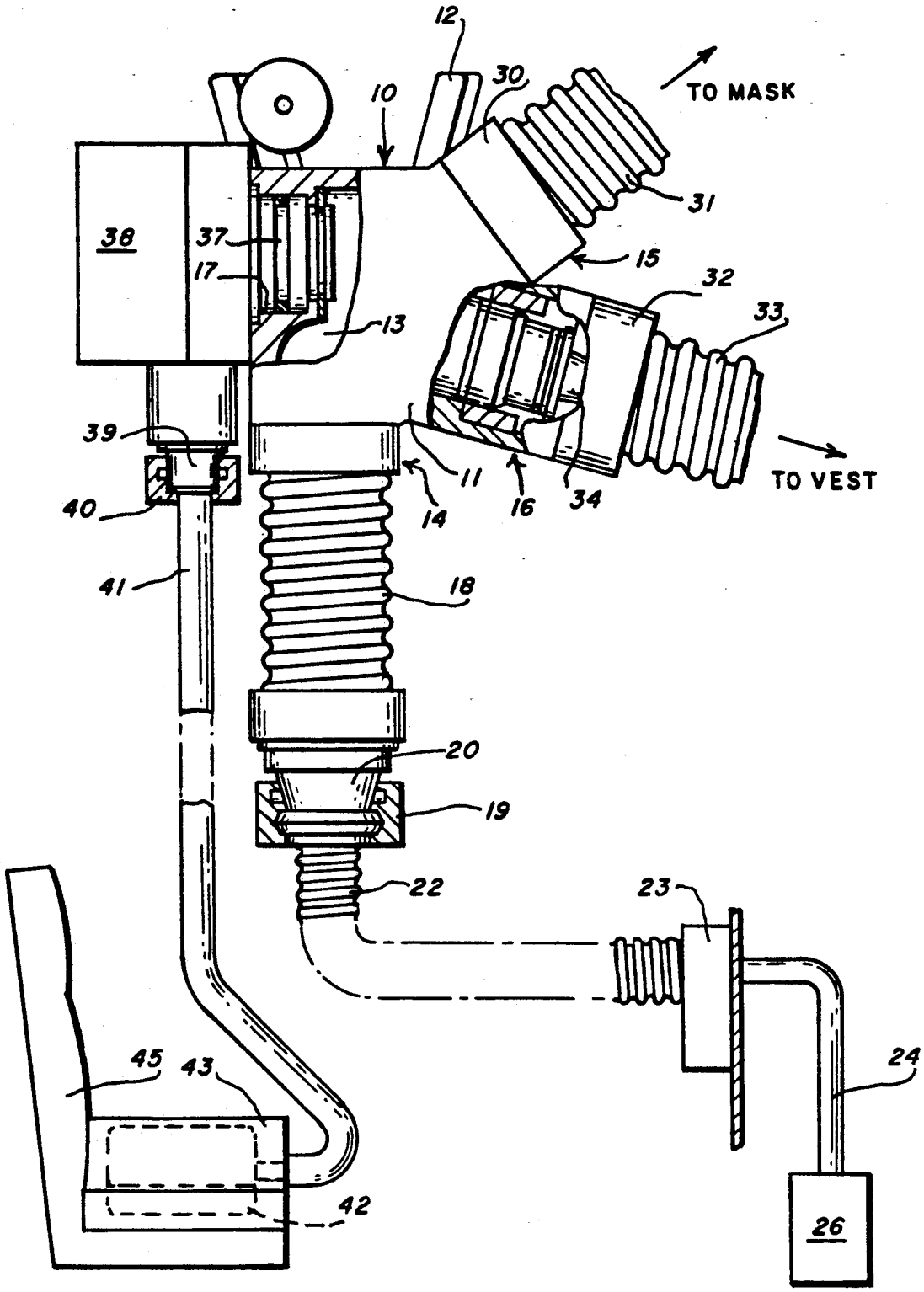
12
10
30
TO MASK
31
38
37
17
15
32
33
13
39
11
TO VEST
40
14
16
34
41
18
20
19
22
23
45
43
24
42
26

CHEST-MOUNTED BREATHING GAS TERMINAL BLOCK ASSEMBLY

BACKGROUND OF THE INVENTION

The invention relates to a chest-mounted breathing gas terminal block assembly which is mounted on the personal flight equipment of a pilot.

Chest-mounted breathing gas terminal blocks are well known in the art. Such terminal blocks attach to a pilot's personal flight equipment and include an inlet for receiving breathing gas from an aircraft-mounted regulator and an outlet which couples to the breathing mask. A second outlet may be provided which couples to a chest counter-pressure vest which inflates during high G maneuvers to prevent pilot blackout. In certain situations, it may be necessary for the pilot to eject from the aircraft while in flight, and the pilot's seat is provided with a release and ejection mechanism for this purpose. During ejection, a connection between the aircraft-mounted regulator and the breathing gas inlet on the coupler block is broken to allow the pilot to separate from the aircraft. An emergency breathing gas supply is contained in a bottle located in the seat and stays with the pilot during ejection. The emergency breathing gas supply is provided to the terminal block through a fixed orifice and a small diameter high pressure hose. This provides a continuous flow rate but not pressure regulation. In alternate configurations, an emergency breathing regulator can be mounted on or adjacent the bottle to meter the flow and pressure of oxygen to the pilot in accordance with the pilot's breathing requirements. However, in order to provide an adequate supply of regulated breathing gas for the pilot, a large diameter low pressure hose between the emergency regulator and the terminal block is required. The low pressure hose is bulky and soft and susceptible to being crushed or torn by the blast of air encountered during ejection thus jeopardizing the pilot's breathing supply from the emergency regulator. It would be desirable to provide a conduit for supplying the pilot with emergency breathing gas supply which is not susceptible to damage during the ejection process.

SUMMARY AND OBJECTS OF THE INVENTION

According to the invention, a pneumatic terminal block assembly includes an emergency regulator attached directly thereto. The regulator includes a high pressure inlet which is coupled by a small diameter high pressure hose to the emergency breathing supply in the pilot's seat. Mounting the emergency regulator on the terminal block allows the pilot to breathe regulated gas from the emergency supply and avoids the disadvantage of a soft, large diameter hose connecting the regulator at the emergency supply to the terminal block.

It is accordingly an object of the invention to provide a pneumatic terminal block worn by a pilot which is coupled by a small diameter high pressure hose to an emergency breathing supply.

It is another object of the invention to provide a pneumatic terminal block assembly including an emergency regulator which is worn by a pilot and couples to an emergency breathing supply by means of a small diameter high pressure hose.

These and other objects of the invention will become apparent from the following detailed description in which reference numerals used throughout the description correspond to numerals found on the drawing figures.

BRIEF DESCRIPTION OF THE DRAWINGS

The drawing figure shows a pilot's oxygen system including a pneumatic terminal block assembly according to the invention.

DESCRIPTION OF THE PREFERRED EMBODIMENT

Referring to the drawing figure, there is shown a pneumatic terminal block assembly generally designated by the reference numeral 10. The terminal block 10 comprises a housing 11 and a dovetail baseplate assembly 12 which is received by a mounting fixture on the pilot's harness. The terminal block 10 includes a central manifold chamber 13 having a main inlet port 14, a mask outlet port 15, a vest outlet port 16, and an emergency breathing gas inlet port 17. The inlet port 14 is coupled to an inlet hose 18 which is terminated by a break-away connector 19. The break-away connector 19 couples the inlet hose 18 to a large diameter low pressure hose 22 and includes a known mechanism for quick release during pilot ejection and a one-way valve to prevent the escape of breathing gas from the manifold chamber 13 when the low pressure hose 22 separates from the break-away connector 19. The low pressure hose 22 is coupled to a regulator 23 which may be mounted on a panel in the cockpit and receives unregulated, high pressure breathing gas from the main breathing gas supply 26 via a high pressure supply hose 24.

A separable connector 30 couples the mask outlet port 15 to one end of a mask hose 31, the other end of which is connected to the pilot's breathing mask (not shown). A separable connector 32 at the vest outlet port 16 couples the vest outlet 16 to a vest hose 33 which is coupled to the pilot's inflatable counter-pressure vest (not shown). A positive pressure breathing relief valve assembly 34 allows the free passage of breathing gas between the manifold chamber 13 and the vest hose 33 when the vest hose 33 is attached to the vest outlet port 16, and acts as a relief valve for the manifold chamber 13 when there is no vest hose 33.

According to the invention, an emergency breathing gas regulator 38 is mounted directly on the terminal block 10 and includes a high pressure inlet 39 and a low pressure outlet 37. A high pressure connector 40 couples the inlet 39 to a small diameter high pressure hose 41 which is coupled to the emergency breathing gas supply 42 located in the cushion 43 of the pilot's ejection seat 45. The low pressure outlet 37 of the emergency regulator 38 is mounted on the emergency breathing gas inlet port 17 communicating with the manifold chamber 13.

OPERATION OF THE PREFERRED EMBODIMENT

The operation of the invention will be apparent to those skilled in the art. The break-away connector 19 is used to couple the low pressure large diameter breathing hose 22 to the inlet hose 18, and the high pressure connector 40 is used to couple the high pressure small diameter emergency hose 41 from the seat mounted emergency oxygen supply 42 to the high pressure inlet 39. The mask hose 31 couples to the mask outlet port 15 and the vest hose 33 couples to the vest outlet port 16. During flight, the pilot breathes normally through the mask which is supplied with oxygen from the breathing gas supply 26. This supply is regulated by the panel mounted regulator 23 and coupled via the low pressure hose 22 to the inlet hose 18.

In the event the pilot ejects from the cockpit, the inlet hose 18 separates from the low pressure hose 22 by means of the break-away connector 19, and a lanyard (not shown) attached between the emergency breathing gas supply 42 and the cockpit frame opens a valve to start the flow of breathing gas from the seat mounted emergency supply 42. Because the emergency breathing gas regulator is integral with the chest-mounted terminal block assembly 10, the small diameter high pressure hose 41 is used to couple emergency breathing gas from the supply 42 to the terminal block assembly 10. The elimination of a soft, low pressure, large diameter hose for use during the ejection process removes the possibility of hose damage and thus increases the safety of the pilot.

Having thus described the invention, various alterations and modifications will be obvious to those skilled in the art, which alterations and modifications are intended to be within the scope of the invention as defined by the appended claims.

What is claimed is:

1. A pneumatic terminal block assembly which is worn by a pilot and used to couple breathing gas from a main and an emergency supply to a pilot's breathing mask, the terminal block assembly comprising:

a central manifold chamber;

a low pressure inlet which couples to the main supply of breathing gas;

a low pressure hose coupling the low pressure inlet to a regulator for regulating the main supply of breathing gas;

a mask outlet which supplies breathing gas to the pilot's breathing mask;

an emergency breathing gas inlet pilot;

an emergency regulator mounted on the terminal block assembly in communication with the emergency breathing gas inlet port;

a high pressure inlet on the emergency regulator;

means for mounting the terminal block assembly on the flight suit of a pilot; and a small diameter high pressure hose coupling the high pressure inlet to an emergency breathing gas supply;

wherein the low pressure inlet, the mask outlet, and the emergency breathing gas inlet port are all in communication with the central manifold chamber, and whereby the emergency regulator mounted on the terminal block assembly receives emergency breathing gas via the small diameter high pressure hose.

2. A pneumatic terminal block assembly which is worn by a pilot and used to couple breathing gas from a main and an emergency supply to a pilot's breathing mask, the terminal block assembly comprising:

a central manifold chamber;

a low pressure inlet which couples to the main supply of breathing gas;

a low pressure hose coupling the low pressure inlet to a regulator for regulating the main supply of breathing gas;

a mask outlet which supplies breathing gas to the pilot's breathing mask;

an emergency breathing gas inlet port;

an emergency regulator mounted on the terminal block assembly in communication with the emergency breathing gas inlet port;

a high pressure inlet on the emergency regulator;

a small diameter high pressure hose coupling the high pressure inlet to an emergency breathing gas supply; wherein the low pressure inlet the mask outlet, and the emergency gas inlet port are all in communication with the central manifold chamber, and whereby the emergency regulator mounted on the terminal block assembly receives emergency breathing gas via the small diameter high pressure hose; and a break-away connector coupling the low pressure hose to the low pressure inlet whereby the low pressure hose separates from the low pressure breathing gas inlet during pilot seat ejection, and wherein the small diameter high pressure hose remains coupled to the emergency high pressure inlet during seat ejection.

3. The invention of claim 2 wherein the emergency breathing gas supply is located in the pilot's seat, and the small diameter, high pressure hose extends from the pilot's seat to the high pressure inlet on the pneumatic terminal block.

4. The pneumatic terminal block of claim 3 further comprising a vest outlet for coupling the central manifold chamber to a counter-pressure vest worn by a pilot.

* * * * *